US010266986B2

(12) United States Patent
Haggquist

(10) Patent No.: US 10,266,986 B2
(45) Date of Patent: Apr. 23, 2019

(54) INCORPORATION OF ACTIVE PARTICLES INTO SUBSTRATES

(71) Applicant: Cocona, Inc., Boulder, CO (US)

(72) Inventor: Gregory W. Haggquist, Longmont, CO (US)

(73) Assignee: Cocona, Inc., Boulder, CO (US)

( * ) Notice: Subject to any disclaimer, the term of this patent is extended or adjusted under 35 U.S.C. 154(b) by 680 days.

(21) Appl. No.: 14/628,236

(22) Filed: Feb. 21, 2015

(65) Prior Publication Data

US 2015/0240415 A1 Aug. 27, 2015

Related U.S. Application Data

(60) Provisional application No. 61/943,033, filed on Feb. 21, 2014.

(51) Int. Cl.

| | |
|---|---|
| ***D06P 1/94*** | (2006.01) |
| ***D06M 11/44*** | (2006.01) |
| ***D06M 11/46*** | (2006.01) |
| ***D06M 11/74*** | (2006.01) |
| ***D06M 11/76*** | (2006.01) |
| ***D06M 11/79*** | (2006.01) |
| ***D06M 15/05*** | (2006.01) |
| ***D06M 15/53*** | (2006.01) |
| ***D06M 15/59*** | (2006.01) |
| ***D06M 16/00*** | (2006.01) |

(Continued)

(52) U.S. Cl.

CPC ..... *D06M 23/00* (2013.01); *D06M 11/44* (2013.01); *D06M 11/46* (2013.01); *D06M 11/74* (2013.01); *D06M 11/76* (2013.01); *D06M 11/79* (2013.01); *D06M 15/05* (2013.01); *D06M 15/227* (2013.01); *D06M 15/233* (2013.01); *D06M 15/263* (2013.01); *D06M 15/333* (2013.01); *D06M 15/507* (2013.01); *D06M 15/53* (2013.01); *D06M 15/564* (2013.01); *D06M 15/59* (2013.01); *D06M 16/00* (2013.01); *D06M 23/08* (2013.01); *D06M 23/105* (2013.01); *D06M 23/12* (2013.01); *D06P 1/94* (2013.01); *D06M 2101/32* (2013.01); *Y10T 428/249921* (2015.04)

(58) Field of Classification Search

USPC ..... 428/364, 359, 357, 221; 8/581, 587, 602

See application file for complete search history.

(56) References Cited

U.S. PATENT DOCUMENTS 3,057,674 A 10/1962 Musser et al.
5,246,737 A 9/1993 Muradov (Continued)

FOREIGN PATENT DOCUMENTS

CN 103114435 A 5/2013

OTHER PUBLICATIONS

Moussaid, El Mostafa, "International Preliminary Report on Patentability re Application No. PCT/US2015/016984", dated Sep. 1, 2016, p. 11.

(Continued)

*Primary Examiner* — Lynda Salvatore

(74) *Attorney, Agent, or Firm* — Adsero IP

(57) ABSTRACT

An active particle bonding system comprising an active particle, a material chemically bonded to the active particle, and a substrate embedded to at least one of the active particle and the material.

20 Claims, 4 Drawing Sheets

(51) Int. Cl.

| | |
|---|---|
| ***D06M 23/00*** | (2006.01) |
| ***D06M 23/08*** | (2006.01) |
| ***D06M 23/10*** | (2006.01) |
| ***D06M 23/12*** | (2006.01) |
| ***D06M 101/32*** | (2006.01) |
| ***D06M 15/227*** | (2006.01) |
| ***D06M 15/233*** | (2006.01) |
| ***D06M 15/263*** | (2006.01) |
| ***D06M 15/333*** | (2006.01) |
| ***D06M 15/507*** | (2006.01) |
| ***D06M 15/564*** | (2006.01) |

(56) References Cited

U.S. PATENT DOCUMENTS

| | | | | | |
|---|---|---|---|---|---|
| 5,571,618 | A * | 11/1996 | Hansen | A61F 13/0209 428/357 |
| 5,972,808 | A | 10/1999 | Groeger et al. | |
| 6,010,542 | A | 1/2000 | DeYoung et al. | |
| 2002/0108183 | A1 | 8/2002 | Smith et al. | |
| 2002/0161123 | A1 | 10/2002 | Li et al. | |
| 2004/0018359 | A1 | 1/2004 | Haggquist | |
| 2006/0046027 | A1 | 3/2006 | Kaminski et al. | |
| 2008/0244840 | A1 * | 10/2008 | Raccurt | B82Y 30/00 8/581 |
| 2009/0039308 | A1 | 2/2009 | Gounko et al. | |
| 2010/0017973 | A1 | 1/2010 | Detering et al. | |

OTHER PUBLICATIONS

Copenheaver, Blaine R., "International Preliminary Report and Written Opnin re Application No. PCT/US2015/016984", dated Jun. 2, 2015, p. 12, Published in: US.

Yanyan, Cheng, "Chinese Office Action Re Application No. 201580009729.8", dated Aug. 17, 2017, p. 22, Published in: CN.

Menard, Claire, "European Search Report Re Application No. 15751578.4", dated Sep. 29, 2017, p. 9, Published in: EP.

European Patent Office, "European Office Action Re Application No. 15751578.4", dated Oct. 17, 2017, p. 1, Published in: EP.

Clarivate Analytics, "WPI 2017 Clarivate Analytics", 2017, p. 3.

Yanyan, Cheng, "Chinese Office Action Re Application No. 201580009729.8", dated Apr. 3, 2018, p. 7, Published in: CN.

Paul Keane, "Response to European Written Opinion dated Sep. 29, 2017", Apr. 26, 2018, p. 4, Published in: EP.

* cited by examiner

INCORPORATION OF ACTIVE PARTICLES INTO SUBSTRATES

FIELD OF THE INVENTION

This invention is related to materials comprising active particles. In particular, but not by way of limitation, the invention is related to incorporating active particles into textiles and polymers using a dying process.

BACKGROUND OF THE INVENTION

Active particles have been incorporated into fabrics using a wide range of methods. These methods range from printing on to membranes, to incorporating the active particles on the textiles themselves, to incorporating active particles into the yarn via a master batch from which the yarn is created. In all these methods, in order to realize the full benefits from the active particles upon creation of the final product, the active particles should be prevented from being deactivated, coated or covered. Furthermore, to realize the full benefits of the addition of active particles all of these methods require an interaction between the external environment and the active particle surface in order for the benefits of the active particles to be present in the final product.

SUMMARY OF THE INVENTION

In order to create a fabric final product comprising active particles that have not been deactivated, a system, fabric, and fiber were developed. One such embodiment comprises an active particle bonding system. One active particle bonding system comprises an active particle, a material chemically bonded to the active particle (i.e., a polymer anchor), and a substrate which is embedded with either the active particle or the polymer anchor. The embedding of the active particle and or the polymer anchor occurring during a textile dying process.

Another embodiment comprises a method of coupling one or more active particles to a fiber that can be part of a textile product. One such method comprises chemically bonding a material (polymer anchor) to the one or more active particles and swelling the fiber. Diffusion of at least one of the one or more active particles and the material into the fiber occurs. At this point, the fiber volume is reduced, at which point the one or more active particles are operatively coupled or embedded in to the fiber.

Yet another embodiment of the invention comprises a fiber. One such fiber comprises a substrate operatively coupled to an active particle and a material chemically bonded to the active particle. In one such embodiment, the material is miscible with the substrate, with at least one of the active particle and the material being coupled to the substrate through chemical diffusion.

BRIEF DESCRIPTION OF THE DRAWINGS

Various objects and advantages and a more complete understanding of the present invention are apparent and more readily appreciated by reference to the following Detailed Description and to the appended claims when taken in conjunction with the accompanying Drawings wherein:

DETAILED DESCRIPTION

Definitions are given to the terms and phrases located within quotation marks (“ ”) in the following paragraph. These definitions are intended to be applied to the terms and phrases throughout this document, including in the claims, unless clearly indicated otherwise in context. Further, as applicable, the stated definitions are to apply, regardless of the word or phrase’s case, tense or any singular or plural variations of the defined word or phrase.

The term “or” as used in this specification and the appended claims is not meant to be exclusive; rather the term is inclusive meaning “either or both”. References in the specification to “one embodiment”, “an embodiment”, “a preferred embodiment”, “an alternative embodiment”, “a variation”, “one variation”, and similar phrases mean that a particular feature, structure, or characteristic described in connection with the embodiment is included in at least an embodiment of the invention. The appearances of phrases like “in one embodiment”, “in an embodiment”, or “in a variation” in various places in the specification are not necessarily all meant to refer to the same embodiment or variation.

Figure 1:
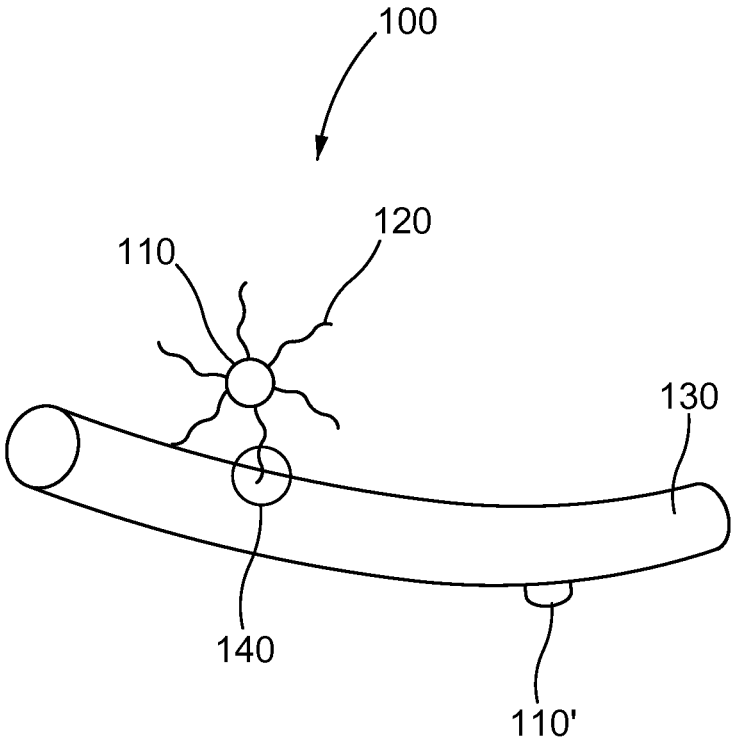
FIG. 1 depicts an active particle bonding system according to one embodiment of the invention.

Turning now to FIG. 1, seen is one embodiment of an active particle bonding system 100 for use in the creation of fabrics and textiles, amongst other products. One active particle bonding system 100 comprises an active particle 110, a material 120, and a substrate 130. Active particles 110 are particles that have pores or traps that have the capacity to adsorb and desorb substances in solid, liquid, and/or gas phases, and/or combinations thereof. These pores can vary in size, shape, and quantity, depending on the type of active particle 110 that is being used. For example, some active particles 110 naturally have pores, such as volcanic rock, and other active particles 110 such as carbon may be treated with extreme temperature and an activating agent such as oxygen to create the pores.

Active particles 110 can provide performance enhancing properties to the item they are included within. Such performance enhancing properties include odor adsorption, moisture management, humidity capture and release, ultraviolet light protection, infrared absorbance, chemical agent protective properties, bio-hazard protective properties, fire retardance, antibacterial protective properties, antiviral protective properties, antifungal protective properties, antimicrobial protective properties, desiccant properties, and combinations thereof. Active particles 110 can include, but are not limited to, activated carbon, carbon nano tunes, carbenes, graphite, aluminum oxide (activated alumina), silica gel, soda ash, aluminum trihydrate, baking soda, p-methoxy-2-ethoxyethyl ester Cinnamic acid (cinoxate), zinc oxide, zeolites, titanium dioxide, silicon dioxide, molecular filter type materials, and other suitable materials.

In one embodiment, the material 120 is chemically bonded to the active particle 110. For example, the active particle 100 may be initially treated, or reacted, with the material 120 to create the chemical bond. Any material 120 may be used which chemically bonds with the active particle 100 and is also miscible with the substrate 130. For example, one portion of the material may bond to the active particle while another portion of the material may couple to the substrate 130, as shown below. The material 120 may comprise an end-functional long chain group and may be referred to herein as a long-chain group, a functional group, a reactive group, an amine group, an anchor, or an anchoring group. Other material 120 types comprise long-chain groups related to one or more of a cellulose, polyether, end-functional amine groups, polyester, polyvinyl alcohol, polystyrene, polyacrylic, modified polyacrylic, polypropylene, polyurethane (aliphatic and aromatic), aramids, and polyamide.

The substrate 130 may comprise a polymer, a polymeric blend or a natural fiber. Furthermore, the substrate 130 may be referred to herein as a polymer, polymeric fiber, natural fiber, or fiber. In one embodiment, the substrate 130 may comprise one or more polyester or natural fiber groups. In such an embodiment, the material 120 may comprise a polyether having an end-functional amine group. The active particles 110 in such an embodiment may first react with a first portion of the end-functional amine group. One first portion may comprise a first end of the end-functional amine group. A second portion (e.g. a second end of the end-functional amine group) may couple to the substrate 130, as described below. Therefore each end-functional amine group may chemically bond to the active particle 110 and couple to the substrate 130.

For example, upon chemically-bonding to the active particle 110, the material 120 (and/or the active particle 110) is incorporated into the substrate 130. In one such embodiment, the long chain groups are used as anchors to attach the active particle 110 to the fiber during a dying process. Various dying processes known in the art, swell the fiber (i.e., substrate 130), which enables such anchors to couple to the substrate 130. In looking at FIG. 1A, seen is a close-up of section 140 from FIG. 1 during swelling of the fiber. As seen, during such swelling of the fiber 130, the space 135, or volume, between fiber particles 125 is large enough to enable long-chain groups 120 to fit between the fiber particles 125. Such a volume may be referred to herein as a "free volume." The fiber particles 125 may also be referred to herein as fiber molecules. Although the space 135 may be large enough to receive the material 120, even during swelling, the space 135 may not be large enough to enable an active particle 110 to fit between the particles 125.

Figure 1A:
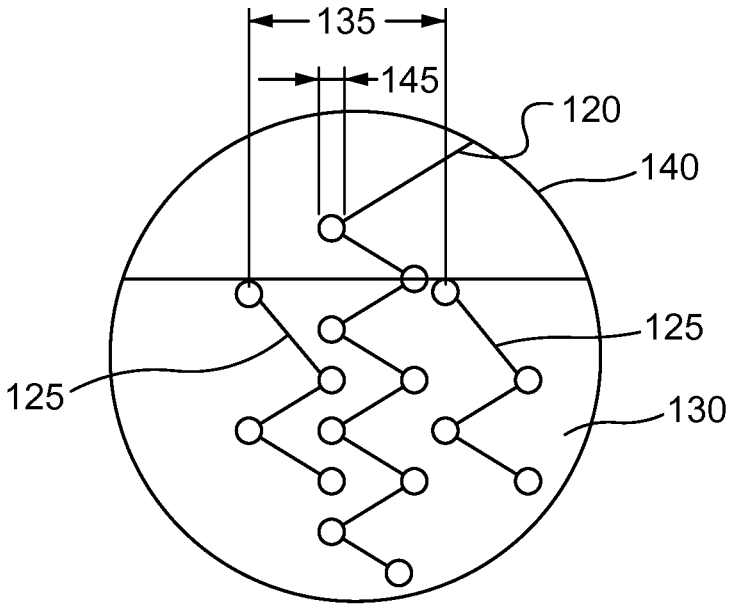
FIG. 1A depicts a close-up of section 140 of FIG. 1 in a swelled condition according to one embodiment of the invention.
Figure 1B:
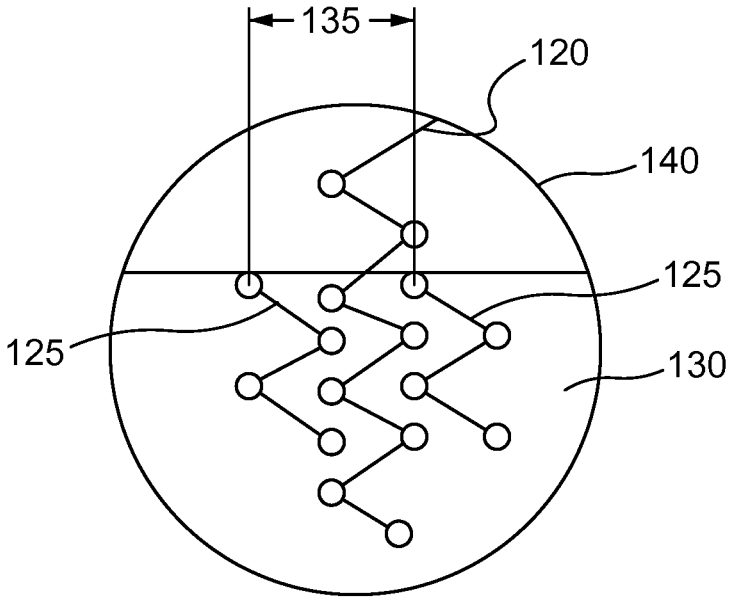
FIG. 1B depicts a close-up of section 140 of FIG. 1 in a non-swelled condition according to one embodiment of the invention.

Turning now to FIG. 1B, seen is a close-up of section 140 from FIG. 1 after the swelling of the fiber has subsided. As seen, the space 135 between the fiber particles 125 in FIG. 1B is smaller than the space 135 between the fiber particles 125 during swelling of the fiber, as seen in FIG. 1A. Due to this reduction in volume in the substrate 130, the long-chain group becomes microscopically entangled in the fiber, locking the material 120, and the attached active particle 110 as seen in FIG. 1, to the fiber. Entanglement of the material 120 and the substrate 130 occurs when the material 120 is miscible with the substrate 130—that is, when the substrate 130 and the material 120 comprise similar, or matching, solubility. Although not shown in FIGS. 1A-1B, it is also contemplated that the space 135 may be large enough that the active particle, seen in FIG. 1, may become entangled, and therefore microscopically locked or anchored, in the substrate's 130 polymer chain.

During swelling, the space 135 is of a size that is to enable long chain particles comprising a particle size 145 from about 1 to about 100 nm to become entangled in the substrate 130. With additional swelling, the space 135 may comprise a size to enable long chain particles comprising a particle size 145 from about 100 nm up to about 1 micron to become entangled in the substrate 130, and with yet further additional swelling, the space 135 may comprise a size to enable long chain particles comprising a particle size 145 from about 1 micron to about 5 microns to become entangled in the substrate 130.

The substrate 130 may comprise one or more of the following materials for use in the creation of fabrics, threads, or any other product: polyester, polyamide, aramids (Kevlar® and Nomex®), cottons, wools, polyurethanes, modified acrylics, polyacrylics, rayons, polypropylenes, other textile fibers or any other material known in the art. It is contemplated that the substrate 130 seen in FIG. 1 may comprise a substrate 130 that has been previously-swelled, as seen in FIG. 1B, which comprises a substrate coupled to the material 120. However, the substrate 130 could also, or in the alternative, be attached to the active particle 110. As seen in FIG. 1, by using the long-chain group as an anchor to couple the active particle 110 to the substrate 130, a greater surface area of the active particle 110 is exposed to the ambient environment, as compared to an active particle 110' coupled directly to the fiber. The active particle 110 may be referred to herein as a first active particle 110 and the active particle 110' may be referred to herein as the second active particle 110'.

Figure 2:
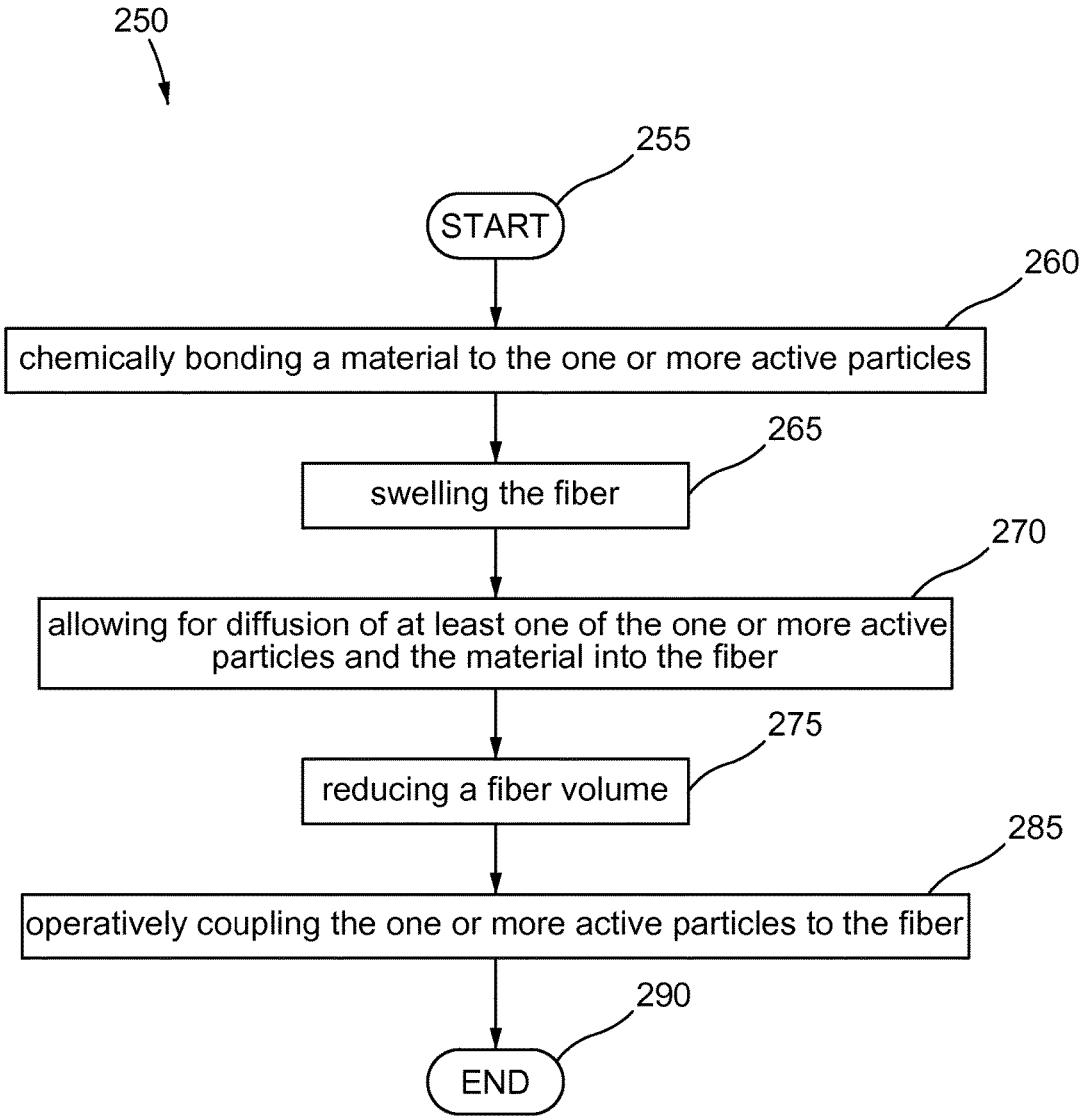
FIG. 2 depicts a method that may be carried out with the embodiments described herein.

Turning now to FIG. 2, seen is a method 250 of coupling one or more active particles to a fiber. For example, the one or more active particles may comprise the active particles 110 seen in FIG. 1 and the fiber may comprise the substrate 130 seen in FIG. 1. One such method starts at 255 and at 260 comprises chemically bonding a material to the one or more active particles 110. For example, and as discussed herein, the material 120 seen in FIG. 1 may chemically bond to the active particle 110. At 265 the method 250 comprises swelling the fiber. For example, the fiber may be swelled during a fiber coloring or dying process known in the art. However, other processes known in the art to swell a fiber are also contemplated. At 270, the method 250 comprises allowing for diffusion of at least one of the one or more active particles 110 and the material 120 into the fiber. For example, and as described above with reference to FIGS. 1A and 1B, during swelling of the fiber, the space 135 may enable diffusion of the one or more active particles 110 and the material 120 into the fiber and microscopic entanglement of the long-chain particles 120 with the fiber particles 125 may occur. For example, entanglement may occur at step 275, which comprises reducing a fiber volume. As described in reference to FIGS. 1A and 1B, reducing a fiber volume may occur when the space 135 between fiber particles 125 is decreased as the fiber transitions from a swelled state, as seen in FIG. 1A, to an non-swelled state, as seen in FIG. 1B. The step at 285 of operatively coupling the one or more active particles 110 to the fiber is also described above with reference to FIGS. 1A and 1B and the accompanying disclosure of the microscopic entanglement of the long chain material 120 and/or the active particle 110 (as seen in FIG. 1) with the fiber particles 125.

As with swelling the fiber at 265, allowing for diffusion of at least one of the one or more active particles and the material into the fiber at 270, reducing a fiber volume at 275 and operatively coupling the one or more active particles to the fiber at 285 may also occur during a dying process. Dying the fiber may be conducted through one or more of a conventional, dispersion, or super critical carbon dioxide ($CO_2$) dying method. Therefore, in one embodiment, a supercritical $CO_2$ dying process can be used to help effectuate steps 265, 270, 275, and 285 of method 250 and incorporate the active particles 100 into the fiber 110 through the use of the material 120. One such material 120 may be the $CO_2$ present during such a process. Therefore, one advantage of using supercritical $CO_2$ is that such a process may not require any further chemicals beyond the $CO_2$ to effectuate the bond of the active particle 100 to the fiber 110. With such an embodiment, the $CO_2$ may act as the material 120 described herein. Furthermore, through using only $CO_2$, the active particles 100 are more likely to be prevented from being deactivated during the dying process since no other chemicals are present in the process.

Deactivation of active particles occurs when a material is coupled to the pores and/or other surface areas of the active particles and blocks their ability to absorb, adsorb, and desorb a substance. Active particles are particles that comprise pores or other surface area features which can adsorb, absorb, and desorb a substance or have the potential to adsorb, absorb, and desorb a substance. Active particles can exist in a deactivated state when the pores and/or the surface area of active particles are blocked or inhibited from adsorbing a substance of certain molecular size. However, this does not always mean that these pores/surface areas are permanently precluded from adsorbing that substance. The pores/surface area of the active particles can be unblocked or uninhibited (i.e., generally or substantially returned to their original state) through reactivation or rejuvenation. Reactivation or rejuvenation removes substances that are trapped in the pores of the active particles, blocking their activity. However, if a deleterious substance is adsorbed by the active particles, it is unlikely that reactivation or rejuvenation can restore the adsorptive capacity of the active particles.

In one embodiment, the active particles may be applied to the substrate during a fabric dying process with or without the aid of a protective layer to prevent permanent deactivation of the active particles. One such protective layer may comprise an encapsulant. An encapsulant is a removable substance that preserves the properties associated with the active particles by preventing premature deactivation (e.g., prevents deleterious or unintended substances from being adsorbed or deactivate through other adverse conditions). The encapsulant can be removed from the active particles at a predetermined time and when subject to application of one or more predetermined conditions (e.g., heat, time, etc.) or substances (e.g., water, light, dispersing agents, solvents, etc.). The encapsulant can include, but is not limited to, water-soluble surfactants, other surfactant types, salts (e.g., sodium chloride, calcium chloride), polymer salts, polyvinyl alcohols, waxes (e.g., paraffin, carnauba), photo-reactive materials, biodegradable materials, degradable materials other than biodegradable materials, ethoxylated acetylenic dials, and any other suitable substances. However, through the use of the $CO_2$ dying process, such encapsulants may not be needed since deleterious substances are not present in during the process.

It is contemplated that the step 260 of chemically bonding a material 120 to the one or more active particles 110 may comprise chemically bonding the material 120 to the one or more active particles 110 before swelling the fiber, chemically bonding the material 120 to the one or more active particles 110 during swelling the fiber, or both. For example, prior to swelling the fiber (e.g., prior to beginning the dying process such as, but not limited to, the supercritical $CO_2$ process) the active particles 110 may be chemically bonded to one or more of the materials 120 described above through a separate chemical bonding process. After the bonding of the active particles 110 and the material 120 occurs, the active particle/material combination may be entered into the dying process prior to the dying process begins or at any point of the process.

As described previously, the material 120 may comprise one or more long chain groups. In such an embodiment, the step 270 of allowing for diffusion of at least one of the one or more active particles 110 and the material 120 into the fiber may comprise automatically selecting the one or more active particles 110 and the one or more long chain groups for diffusion into the fiber by a size of the one or more active particles 110 and the one or more long chain groups. For example, and as shown and described above with reference to FIGS. 1A and 1B, diffusion may occur based on the size of the space 135 and volume between fiber particles 125. If the space/volume is spread out and large enough during swelling of the fiber, then active particles 110 may be diffused within the substrate 130. However, if the active particles 110 are larger than the volume/space, then the active particles 110 will not be diffused within the substrate 130. Therefore, the larger the active particle, the harder it is to diffuse. Similarly, during swelling of the fiber, the space/volume may be large enough for diffusion of the long chain groups and substrate 130 to occur. However, if the fiber has not swelled, diffusion between the long chain groups and substrate 130 is less likely to occur because the space/volume may be insufficient to allow for the long chain groups to become entangled with the fiber particles 125. Therefore, the size of the long chain groups and active particles 110 determine whether the active particles 110 and/or the long chain groups are coupled to the substrate 130, with the properly-sized long chain groups and active particles 110 (ones which become entangled) being automatically selected as anchors. So, automatically selecting the one or more active particles 110 and the one or more long chain groups for diffusion into the fiber by size of the one or more active particles 110 and the one or more long chain groups comprises receiving the one or more active particles 110 and the one or more long chain groups based on a size of the one or more active particles 110 and the one or more long chain groups that is adapted to fit in one or more areas in the swelled fiber based on the space 135 (i.e. volume) in the substrate 130. Reducing a fiber volume comprises diminishing the space between a plurality of fiber particles 125. In one such embodiment, the substrate 130 may comprise a polyester and the material 120 may comprise a polyether having an end-functional amine group that is used to attach the polyether to the fiber.

As seen in FIG. 1, a surface area exposed to the ambient environment (the area surrounding the system 100) of the first active particle 110 that is coupled to the fiber through diffusion of the material 120 into the fiber is greater than the surface area exposed to the ambient environment of the second active particle 110' coupled to the fiber through diffusion of the second active particle 110' into the fiber. The method 250 ends at 290.

Figure 3:
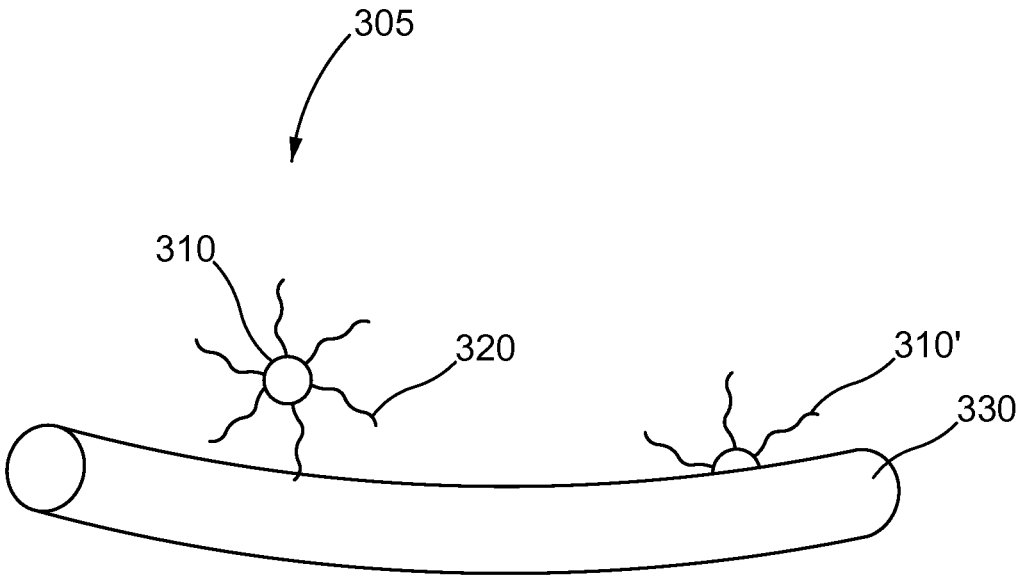
FIG. 3 depicts a fiber according to one embodiment of the invention.

Another embodiment of the invention may be referred to herein as a fiber. The fiber 305 seen in FIG. 3 is similar to the system 100 described above with respect to FIG. 1 and hereby incorporates the description herein related to the system 100 and applies the entire description to the fiber 305 in FIG. 3. Similarly, the description, below, of the fiber 305 may be applied to the system 100 seen in FIG. 1.

In one embodiment, the fiber 305 comprises polymeric material having a substrate 330 and at least one active particle 310. Material 320 may be chemically bonded to the active particle 310. As described above, the material 320 should be miscible (compatibly soluble) with the substrate 330, comprise a reactive group to chemically bond with the active particle 310, and at least one of the active particle 310 and the material 320 is coupled to the substrate through diffusion. For example, the active particle 310' seen in FIG. 3 is coupled to the substrate 330. Furthermore, the reactive group may comprise a polyether having an end-functional amine group. As described above, the active particle 310 and/or the material 320 may be coupled to the substrate 330 through diffusion upon swelling of the substrate 330 during a dying process such as, but not limited to, a supercritical $CO_2$ dying process. It is contemplated that the end-functional amine group may comprises a plurality of long-chain groups and that at least one of the long-chain groups chemically bonds to the active particle. In such an embodiment, diffusion of the at least one of the long-chain groups into the substrate may occur.

One anchoring group may comprise a reactive portion, or site, that chemically bonds to the active particle 100. Such an anchoring group may be included before the dying process is initiated, or, the long-chain group 120 may attach to the active particle 100 during the dying process. One long chain group 120 may be compatible and miscible to the fiber 110. Furthermore, a dying method may sufficiently swell the fiber 110 so as to allow for the diffusion of the active particles 100 or the anchoring group into the fiber 110. Particle size pre-classification is not required. The process itself will size select the particles that can be diffused into the swollen fiber. In the Supercritical $CO_2$ process after the dying occurs the unused active particles are recovered.

Those skilled in the art can readily recognize that numerous variations and substitutions may be made in the invention, its use and its configuration to achieve substantially the same results as achieved by the embodiments described herein. Accordingly, there is no intention to limit the invention to the disclosed exemplary forms. Many variations, modifications and alternative constructions fall within the scope and spirit of the disclosed invention as expressed in the claims.

What is claimed is:

1. An active particle bonding system comprising,
a substrate;
a plurality of active particles;
a material chemically bonded to the active particles; and wherein,
the substrate comprises a previously-swelled substrate comprising a plurality of polymer chains; and
the material chemically bonded to the active particles is diffused into the substrate and attached to at least some of the plurality of polymer chains through microscopic entanglement.

2. The active particle bonding system of claim 1 further comprising a free volume within the plurality of polymer chains found in the substrate.

3. The active particle bonding system of claim 2 wherein, a volume between the plurality of polymer chains is reduced upon the substrate transferring from a swelled-state to an non-swelled-state.

4. The active particle bonding system of claim 1, wherein the material is miscible with the previously-swelled substrate.

5. The active particle bonding system of claim 1 wherein, the previously-swelled substrate is attached to at least one of the active particle and the material during a dyeing process.

6. A method comprising,
chemically bonding a material to one or more active particles;
swelling a fiber;
allowing for diffusion of the material chemically bonded to the one or more active particles into the swelled fiber;
reducing a volume of the swelled fiber to a non-swelled substrate; and
operatively coupling the material chemically bonded to the one or more active particles to the fiber to form a fiber having the non-swelled substrate and the material chemically bonded to the one or more active particles; and
wherein,
the non-swelled substrate comprises a plurality of polymer chains,
the material chemically bonded to the active particles is,
diffused into the non-swelled substrate, and
attached to at least some of the plurality of polymer chains through microscopic entanglement.

7. The method of claim 6 wherein, chemically bonding a material to the one or more active particles comprises one of,
chemically bonding the material to the one or more active particles before swelling the fiber; and
chemically bonding the material to the one or more active particles during swelling the fiber.

8. The method of claim 6 wherein, swelling the fiber occurs during a supercritical $CO_2$ process to dye the fiber.

9. The method of claim 6 wherein, swelling the fiber occurs during a dispersion process to dye the fiber.

10. The method of claim 6, wherein,
the material comprises one or more long chain groups;
allowing for diffusion of the material chemically bonded to the one or more active particles into the swelled fiber comprises automatically selecting the one or more active particles and the one or more long chain groups for diffusion into the swelled fiber by size of the one or more active particles and the one or more long chain groups.

11. The method of claim 10 wherein, automatically selecting the one or more long chain groups for diffusion into the swelled fiber by size of the one or more long chain groups comprises receiving a size of the one or more long chain groups that is adapted to fit in one or more areas in the swelled fiber.

12. The method of claim 11 wherein, the one or more areas in the swelled fiber are adapted to receive the one or more active particles and the one or more long chain groups.

13. The method of claim 6 wherein,
reducing a volume of the swelled fiber comprises diminishing the space between a plurality of fiber particles;
the fiber comprises a polyester;
the material chemically bonded to the one or more active particles comprises at least one of an end-functional long chain group related to one or more of a cellulose, polyether, modified polyacrylic, an end-functional amine group, polyester, polyvinyl alcohol, polystyrene, polyacrylic, polypropylene, polyurethane (aliphatic and aromatic), aramids, and polyamide; and
the material chemically bonded to the one or more active particles is used to attach the polyether to the fiber.

14. The method of claim 6 wherein,
the one or more active particles comprise a first active particle and a second active particle;
the first active particle comprises an active particle coupled to the fiber through diffusion of the material chemically bonded to the one or more active particles into the fiber;

the second active particle comprises an active particle coupled to the fiber through diffusion of the second active particle into the fiber;

the first active particle comprises a first surface area exposed to an ambient environment;

the second active particle comprises a second surface area exposed to the ambient environment; and the first surface area is greater than the second surface area.

15. A textile incorporating one or more fibers, wherein the one or more fibers comprise, a fiber having a substrate;

a plurality of active particles;

a material chemically bonded to the plurality of active particles; and wherein the substrate comprises, a previously-swelled substrate, and a plurality of polymer chains, the material chemically bonded to the plurality of active particles is, diffused into the substrate, and attached to at least some of the plurality of polymer chains through microscopic entanglement.

16. The textile of claim 15 wherein, at least one of the plurality of active particle and the material chemically bonded to the plurality of active particles are coupled to the substrate through diffusion upon swelling of the substrate during a textile dyeing process; and the material chemically bonded to the plurality of active particles comprises a reactive group.

17. The textile of claim 16 wherein, the dyeing process comprises a supercritical $CO_2$ dyeing process; and the fiber comprises a polymeric material.

18. The textile of claim 16 wherein, the reactive group comprises at least one of an end-functional long chain group related to one or more of a cellulose, polyether, modified polyacrylic, an end-functional amine group, polyester, polyvinyl alcohol, polystyrene, polyacrylic, polypropylene, polyurethane (aliphatic and aromatic), aramids, and polyamide.

19. The textile of claim 18 wherein, the end-functional amine group comprises a plurality of long-chain groups;

at least one of the long-chain groups chemically bonds to the plurality of active particles; and diffusion of the at least one of the long-chain groups into the substrate occurs by automatically selecting the plurality of active particles and the plurality of long-chain groups by size of the plurality of active particles and the plurality of long chain groups.

20. The textile of claim 15 wherein the plurality of active particles are coupled to the substrate.

* * * * *